US006470718B1

(12) United States Patent
Yang

(10) Patent No.: US 6,470,718 B1
(45) Date of Patent: Oct. 29, 2002

(54) CABLE LOCK

(75) Inventor: Kuo-Tsung Yang, Taipei (TW)

(73) Assignee: Jin Tay Industries Co., Ltd., Taipei Hsien (TW)

( * ) Notice: Subject to any disclaimer, the term of this patent is extended or adjusted under 35 U.S.C. 154(b) by 0 days.

(21) Appl. No.: 10/071,012

(22) Filed: Feb. 7, 2002

(51) Int. Cl.[7] ..... E05B 37/02
(52) U.S. Cl. ..... 70/30; 70/25; 70/312
(58) Field of Search ..... 70/20, 25, 18, 70/30, 52, 58, 312, 233

(56) References Cited

U.S. PATENT DOCUMENTS 2,190,661 A * 2/1940 Hauer ..... 70/49
3,585,823 A * 6/1971 Nagel ..... 70/49
3,590,608 A * 7/1971 Smyth ..... 70/58
3,728,879 A * 4/1973 Best ..... 70/49 X
4,086,795 A * 5/1978 Foster et al. ..... 70/49 X
4,236,394 A * 12/1980 Harrington et al. ..... 70/25
4,422,311 A * 12/1983 Zabel et al. ..... 70/25
4,476,698 A * 10/1984 Treslo ..... 70/25
4,610,152 A * 9/1986 Duringer ..... 70/30
4,896,517 A * 1/1990 Ling ..... 70/18
5,367,785 A * 11/1994 Benarroch ..... 70/30 X
5,560,232 A * 10/1996 Chen ..... 70/30
5,791,170 A * 8/1998 Officer ..... 70/49
5,832,752 A * 11/1998 Zeller ..... 70/30
5,868,012 A * 2/1999 Chun-Te et al. ..... 70/30
5,953,940 A * 9/1999 Ling ..... 70/25
5,960,652 A * 10/1999 Marmstad ..... 70/49
6,227,016 B1 * 5/2001 Yu ..... 70/30
6,363,758 B1 * 4/2002 Ling ..... 70/30

* cited by examiner

*Primary Examiner*—Suzanne Dino Barrett
(74) *Attorney, Agent, or Firm*—Alan D. Kamrath; Rider, Bennett, Egan & Arundel

(57) ABSTRACT

A cable lock includes a body and a cable. A latch hole and an elongated hole are respectively defined at two sides of the body. The cable has a latch head secured in the latch hole, and a fixed head extending through the elongated hole. A button is received in the body and located between the latch hole and the elongated hole. A hook is pivotally mounted in the body. The hook has a straight end pushed by a resilient member, and a curved end clasping the cable in the elongated hole. A shaft with a dial is connected with the button. When the dial is turned to a correct sequence, the latch head can be released from the latch hole, and the cable can be freely moved in the elongated hole to release the locked item.

4 Claims, 11 Drawing Sheets

CABLE LOCK

BACKGROUND OF THE INVENTION

1. Field of the Invention

The present invention is related to a cable lock, and more particularly to a combination lock with an adjustable cable.

2. Description of Related Art

Conventional cable locks generally have a fixed-length cable. Referring to FIG. 17, a conventional combination cable lock is composed of a body (10) and a cable (1). The body (10) is constructed of a first housing and a second housing. A latch hole (11) is defined at a first side of the body (10) and a fixing hole (12) is defined at a second side opposite to the first hole (11). The cable (1) has a latch head (13) inserted in the latch hole (11), and a fixed head (14) secured in the fixing hole (12). A ring notch (18) is defined on the latch head (13). A shaft (15) with dial rings (not numbered) is received in the body (10) and between the latch hole (11) and the fixing hole (12). A button (16) is also received in the body (10) and provided at an upper end of the shaft (15). A ball (17) is provided at a side of the button (16) and pushed by the button (16) to be received in a ring notch (18) for blocking the latch head (13). When the dial rings are turned with a series of correct numbers, the button can be pressed to retract the ball (17) and the latch head (13) can be released from the latch hole (11). However, the length of the cable (1) is fixed and can not be adjusted.

Therefore, the invention provides an improved cable lock to mitigate and/or obviate the aforementioned problems.

SUMMARY OF THE INVENTION

The main objective of the invention is to provide a cable lock that has an adjustable cable. Other structures of the lock are similar to the conventional combination lock. The present invention can be used for securing articles such as an LED monitor or luggage, and is unlocked by means of turning a dial with use of a correct code.

Other objects, advantages and novel features of the invention will become more apparent from the following detailed description when taken in conjunction with the accompanying drawings.

DETAILED DESCRIPTION OF THE PREFERRED EMBODIMENT

Figure 1:
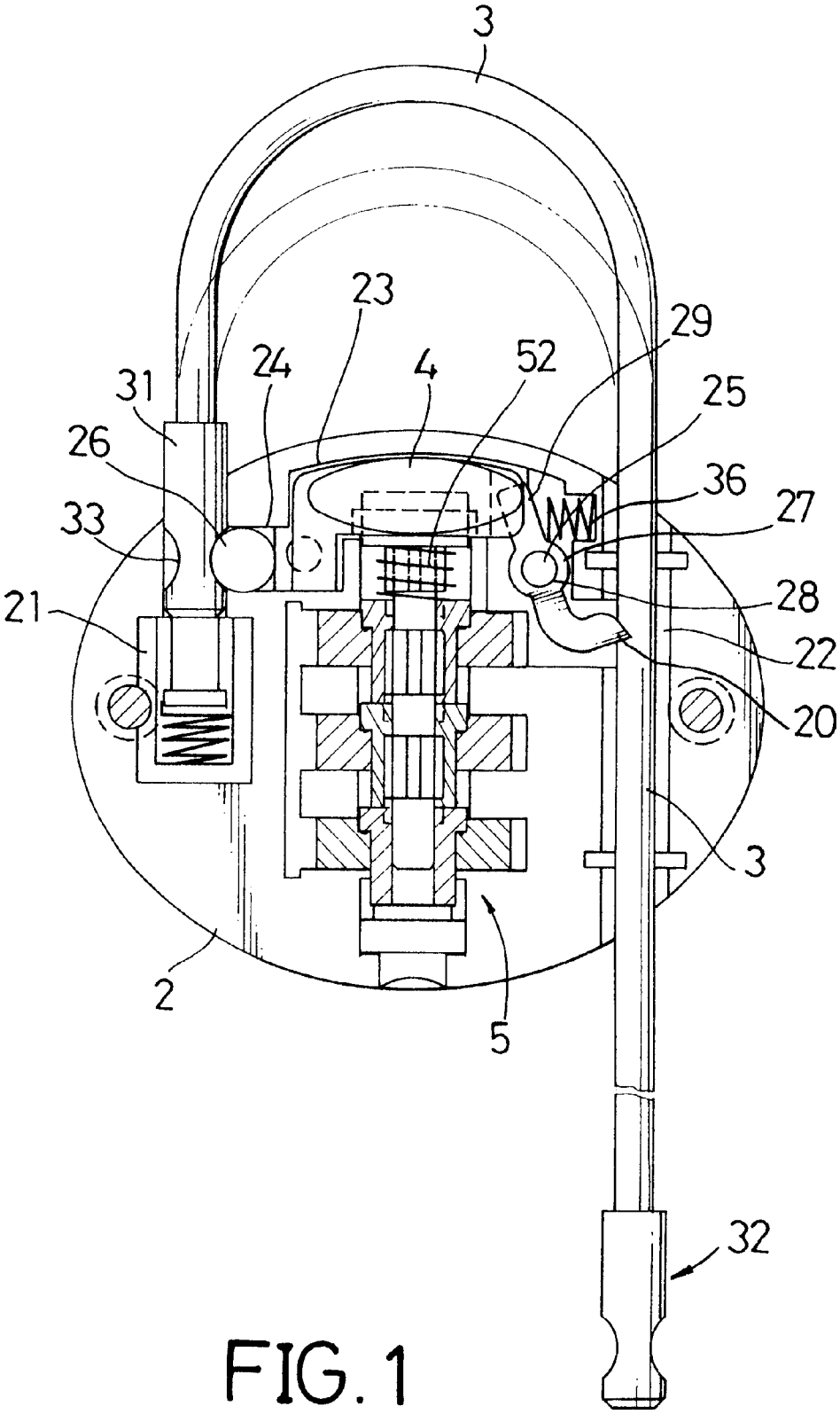
FIG. 1 is a cross sectional view of a cable lock in a locked status in accordance with the invention.
Figure 4:
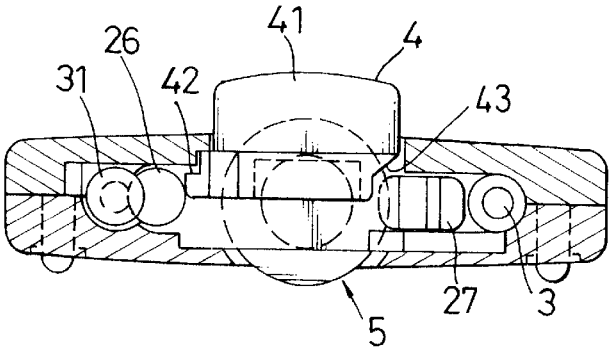
FIG. 4 is a top sectional view of the cable lock in FIG. 2.

Referring to the figures and in particular FIG. 1, a cable lock in accordance with the invention has a body (2) being composed of a first housing and a second housing. Two fasteners are inserted through the first housing and secured on the second housing to engage the two housings, as shown in FIG. 4. This structure is similar to the known conventional lock, so that there are no referential numerals on these components.

Figure 3:
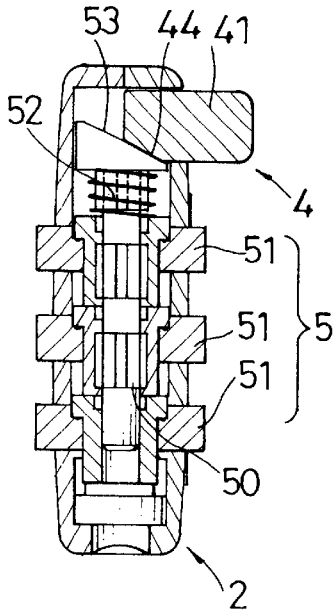
FIG. 3 is a side sectional view of the cable lock in FIG. 2.

The body (2) has a latch hole (21) defined at a first side thereof, and an elongated hole (22) defined at a second side opposite to the first side. A button hole (23) is defined through the first housing and in the second housing (as shown in FIG. 3), and between the latch hole (21) and the elongated hole (22). A slot (24) is defined between the button hole (23) and the latch hole (21), and a ball (26) is received in the slot (24).

A pin (25) is formed between the button hole (23) and the elongated hole (22), and is inserted through a pin hole (28) in a hook (27) to pivotally mount the hook (27) on the pin (25).

Figure 11:
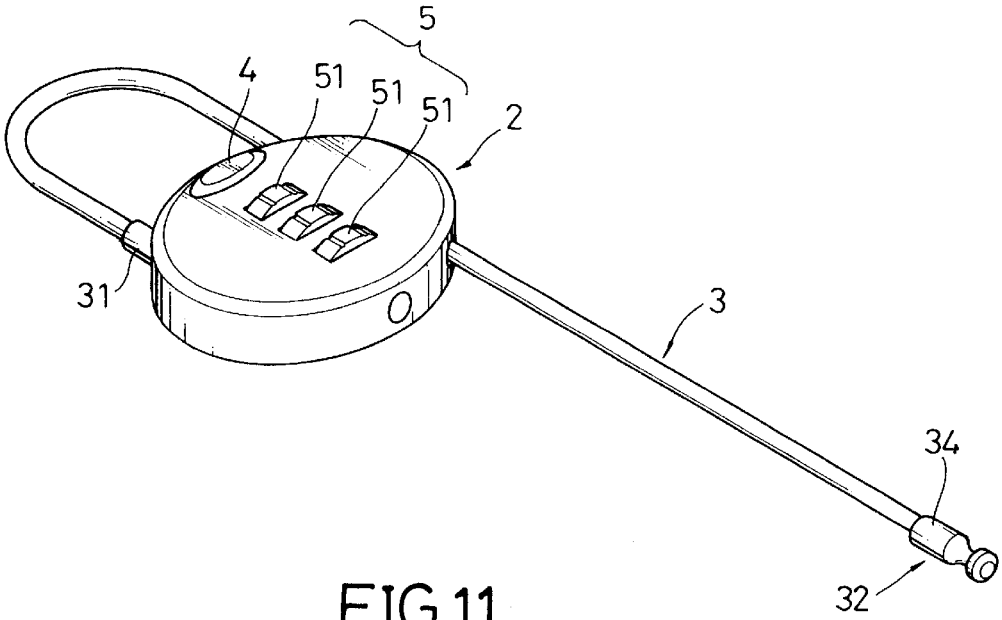
FIG. 11 is a perspective view of a first embodiment of the cable lock in a locking status.
Figure 12:
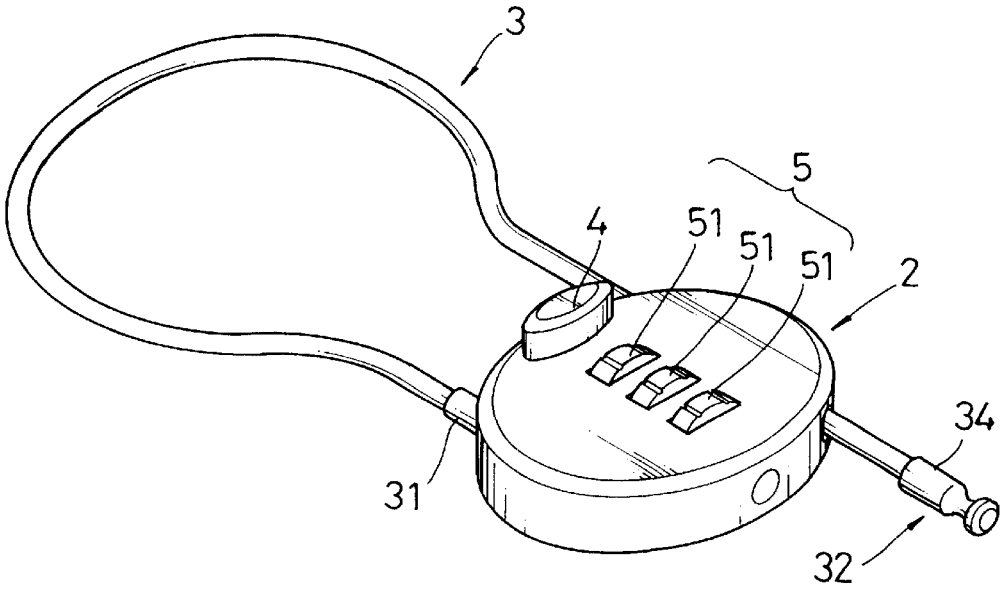
FIG. 12 is a perspective view of the first embodiment of the cable lock in a locked status.
Figure 13:
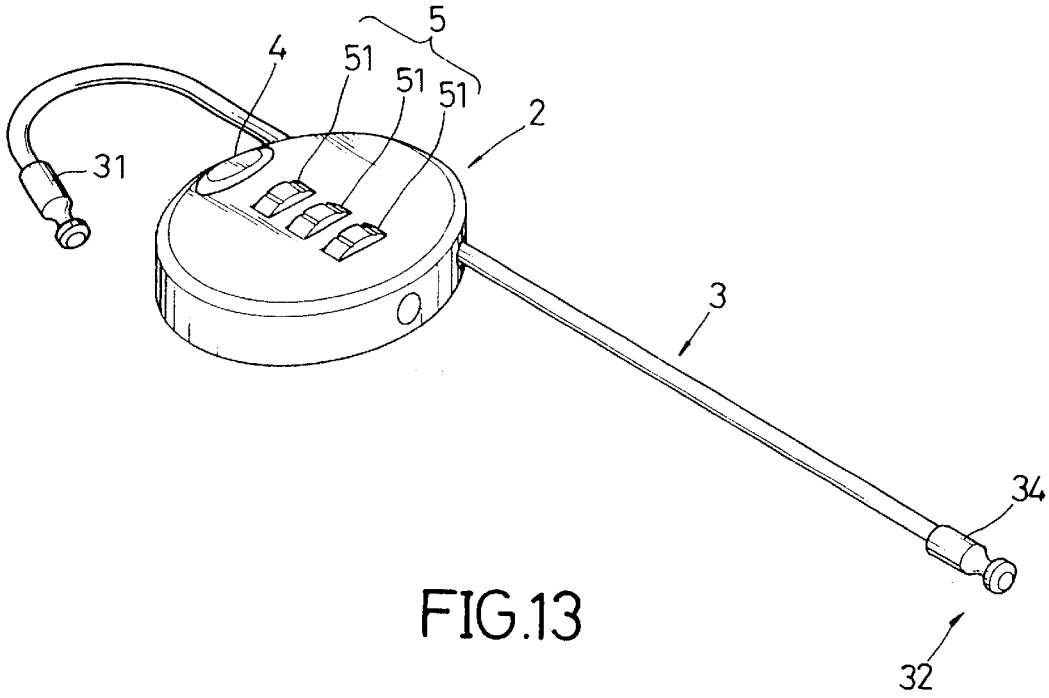
FIG. 13 is a perspective view of the first embodiment of the cable lock in an unlocked status.
Figure 14:
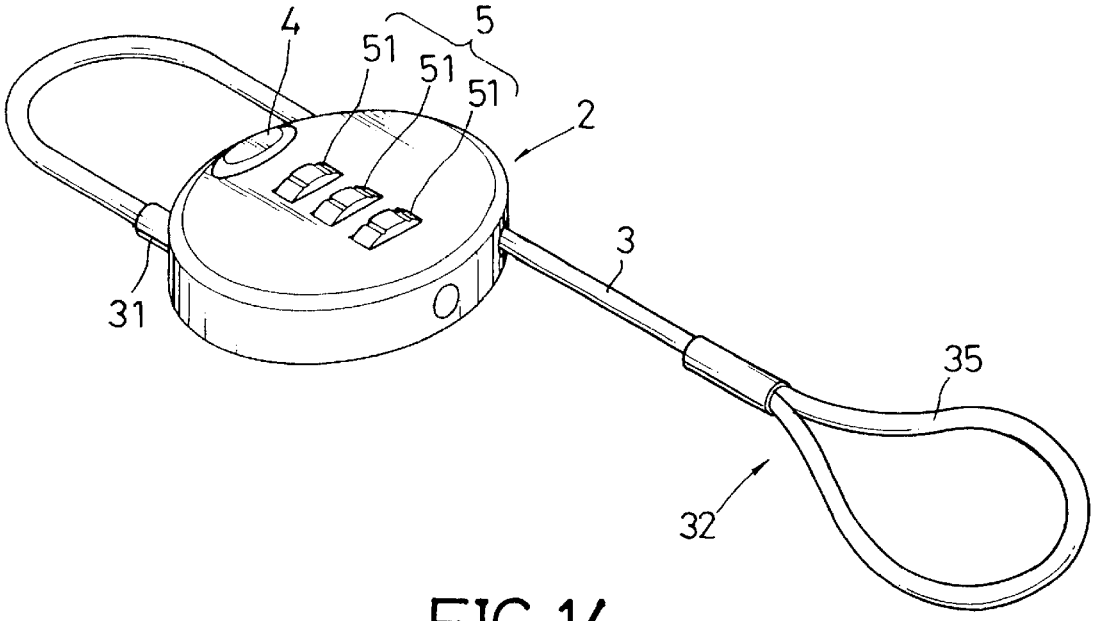
FIG. 14 is a perspective view of a second embodiment of the cable lock in a locking status.
Figure 15:
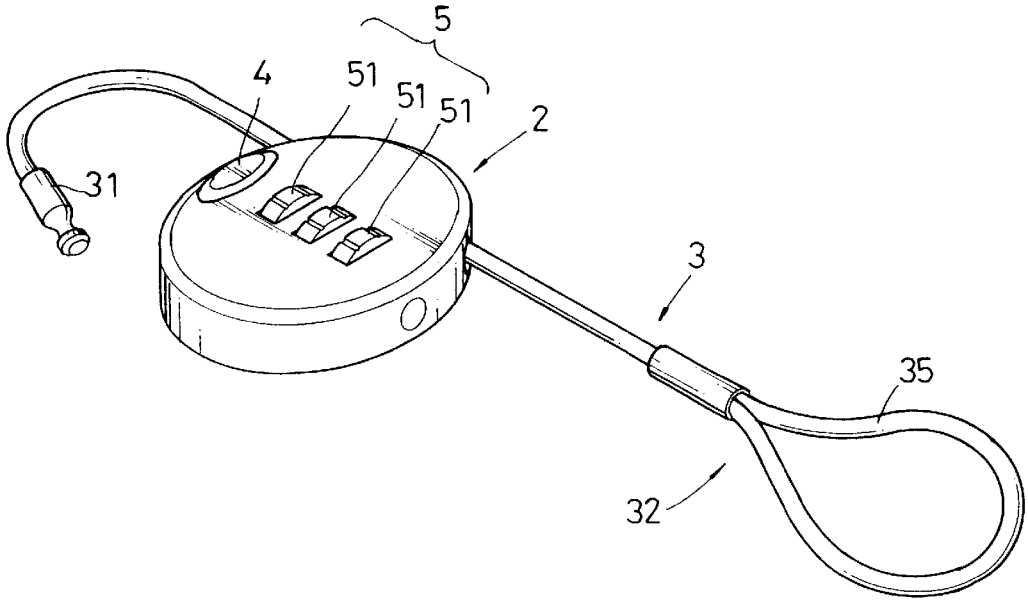
FIG. 15 is a perspective view of the second embodiment of the cable lock in an unlocked status.

A cable (3) has a first latch head (31) secured in the latch hole (21), and a fixed head (32) extending through the elongated hole (22). The fixed head (32) can have a second latch head (34), as shown in FIGS. 11–13, or a cord (35), as shown in FIGS. 14–15.

Figure 2:
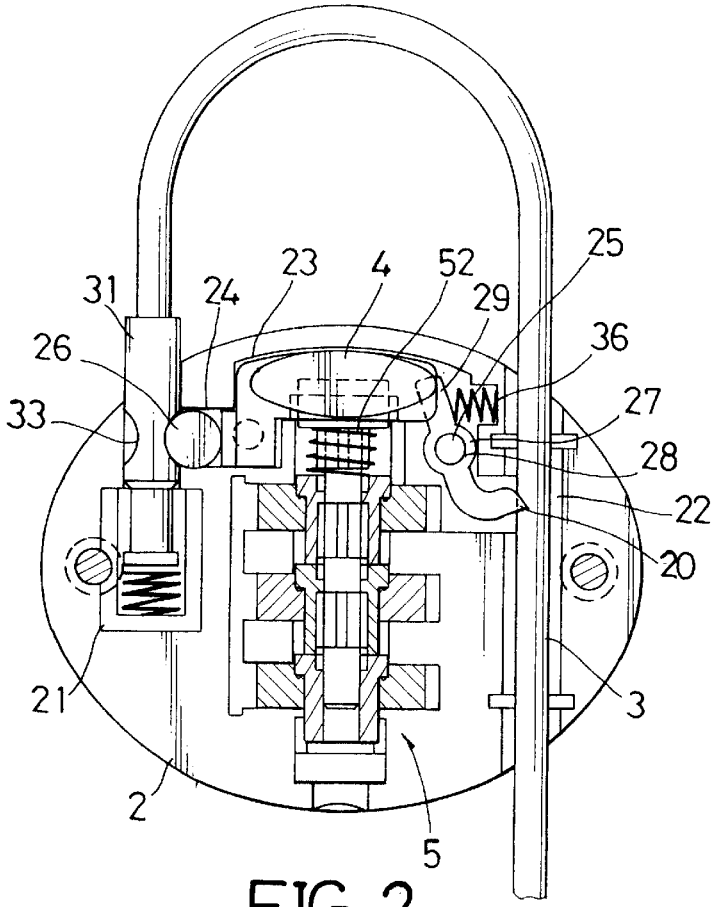
FIG. 2 is another cross sectional view of the cable lock in a locked status.
Figure 5:
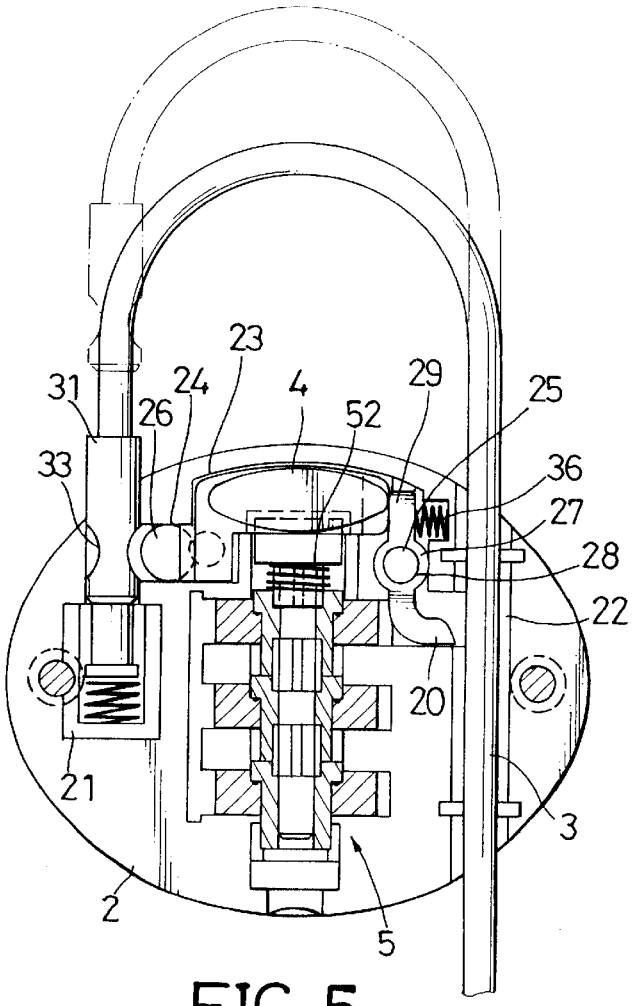
FIG. 5 is a cross sectional view of the cable lock in an unlocked status.
Figure 6:
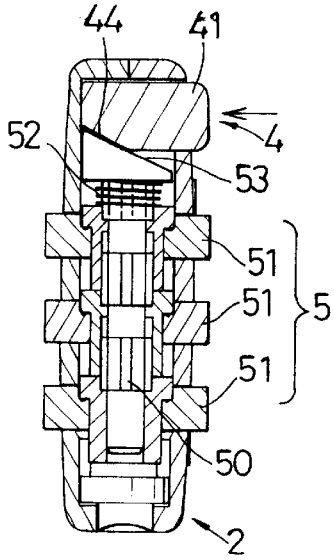
FIG. 6 is a side sectional view of the cable lock in FIG. 5.
Figure 7:
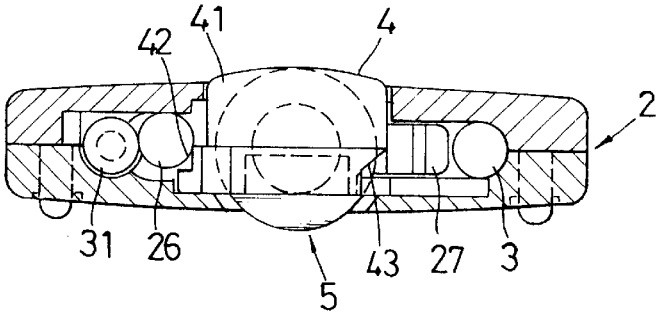
FIG. 7 is a top sectional view of the cable lock in FIG. 5.

Referring to FIGS. 2–4, a button (4) is received in the button hole (23). A shaft (50) on which a dial (5) is mounted is longitudinally provided under the button (4). The button (4) has a protrusion (41) extending out from the button hole (23). A step (42) is formed at a side of the button (4) facing the slot (24). When the button (4) is pressed inwards (as shown in FIGS. 5–7), the step (42) is aligned with the slot (24), and the ball (26) in the slot (24) can roll into the step (42) and escape from the latch hole (21).

Figure 8:
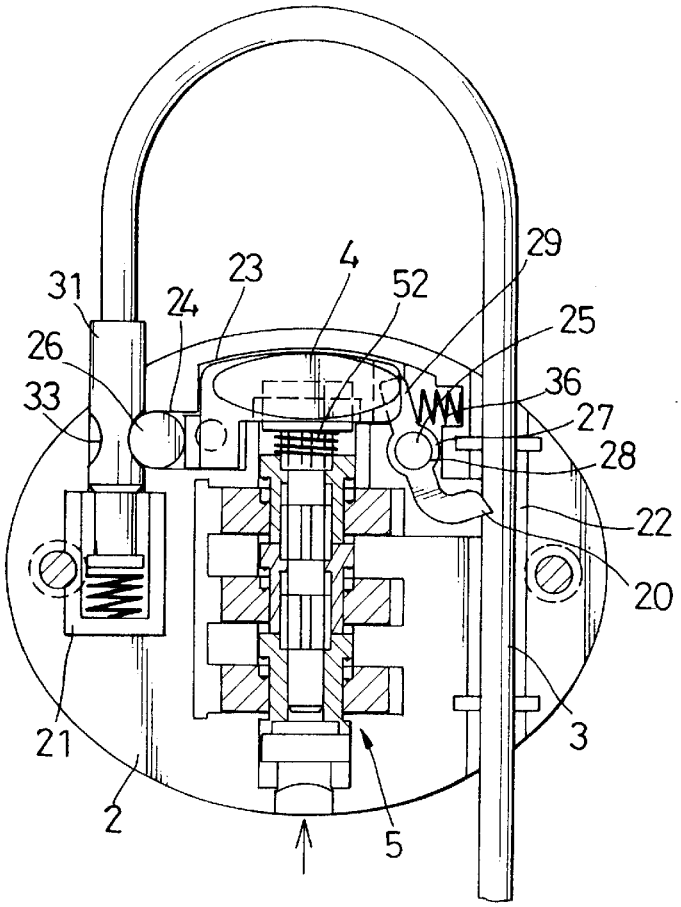
FIG. 8 is a cross sectional view of the cable lock in a code-reset status.
Figure 9:
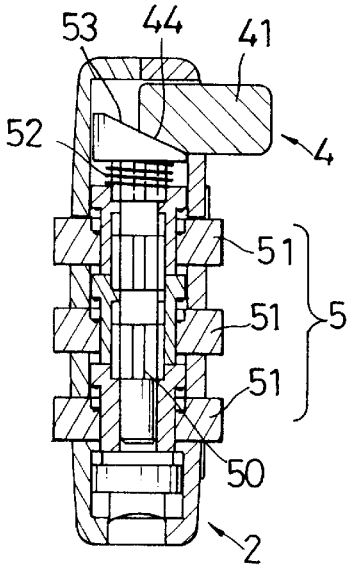
FIG. 9 is a side sectional view of the cable lock in FIG. 8.
Figure 10:
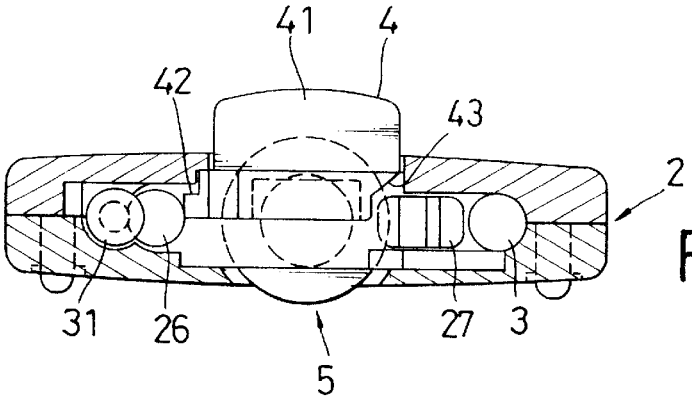
FIG. 10 is a top sectional view of the cable lock in FIG. 8.

The dial (5) on the shaft (50) has three dial-ring assemblies (51) each being composed of a number ring and a positioning ring (neither numbered). When all the number rings are turned to a correct sequence, the shaft (50) is released from the positioning rings and can be moved in the longitudinal direction. An upper inclined surface (53) is formed at a top of the shaft (50) and abuts a bottom inclined surface (44) formed on a bottom of the button (4). A first resilient member (52) is provided under the inclined surface (53). When the numbers of the dial (5) are set in an incorrect sequence, as shown in FIG. 1, the shaft (50) is immovable and the button (4) is blocked by the upper inclined surface (53) of the shaft (50) and cannot be pressed. When the numbers of the dial (5) are in the correct sequence, as shown in FIGS. 2–4, 5–7, or 8–10, the shaft (50) is movable and the button (4) can be pressed inwards and the first resilient member (52) can be compressed. Referring to FIGS. 8–10, when a user wants to change the sequence of the dial (5), the number rings are turned to the original correct sequence, and the shaft (50) is pushed upwards by a tool (not shown or numbered) inserted from a bottom of the body (2) to disengage the number rings and the positioning rings. Thus, the number rings can be singly turned and reset with a new sequence.

The button (4) further has a cutout (43) facing the pin (25). A straight end (29) of the hook (27) abuts the cutout (43), and a curved end (20) of the hook (27) extends in the elongated hole (22) to clasp the cable (3). A second resilient member (36) is provided between the straight end (29) and the body (2).

When the button (4) is pressed inwards, the straight end (29) is pushed by the button (4) to compress the second resilient member (36), so that the hook (27) is pivoted about the pin (25) and the curved end (20) is retracted from the elongated hole (22) whereby the cable (3) is released.

When the sequence of the number rings is incorrect, the fixed end (32) of the cable (3) can be pulled downwards to shorten a length of the cable (3) between the latch hole (21) and the elongated hole (22), as indicated by the dashed lines in FIG. 1. But the cable (3) can not be released because the ball (26) is received in a ring notch (33) on the latch head (31) to secure the latch head (31), and the curved end (20) of the hook (27) is pivoted outwards under the force of the second resilient member (36) to extend in the elongated hole (22) to prevent the cable (3) from being pulled upwards away from the body (2). When the sequence of the number rings is correct, as shown in FIG. 2, the button (4) can be pressed. When the button is fully received in the button hole, the ball (26) can roll into the step (42) to release the latch head (31), and the curved end (20) is pivoted inwards to release the cable (3). Thus, the latch head (31) can be released from the latch hole (21) and the cable (3) can freely move in the elongated hole (22) for adjusting the lock, as shown in FIG. 5.

Figure 16:
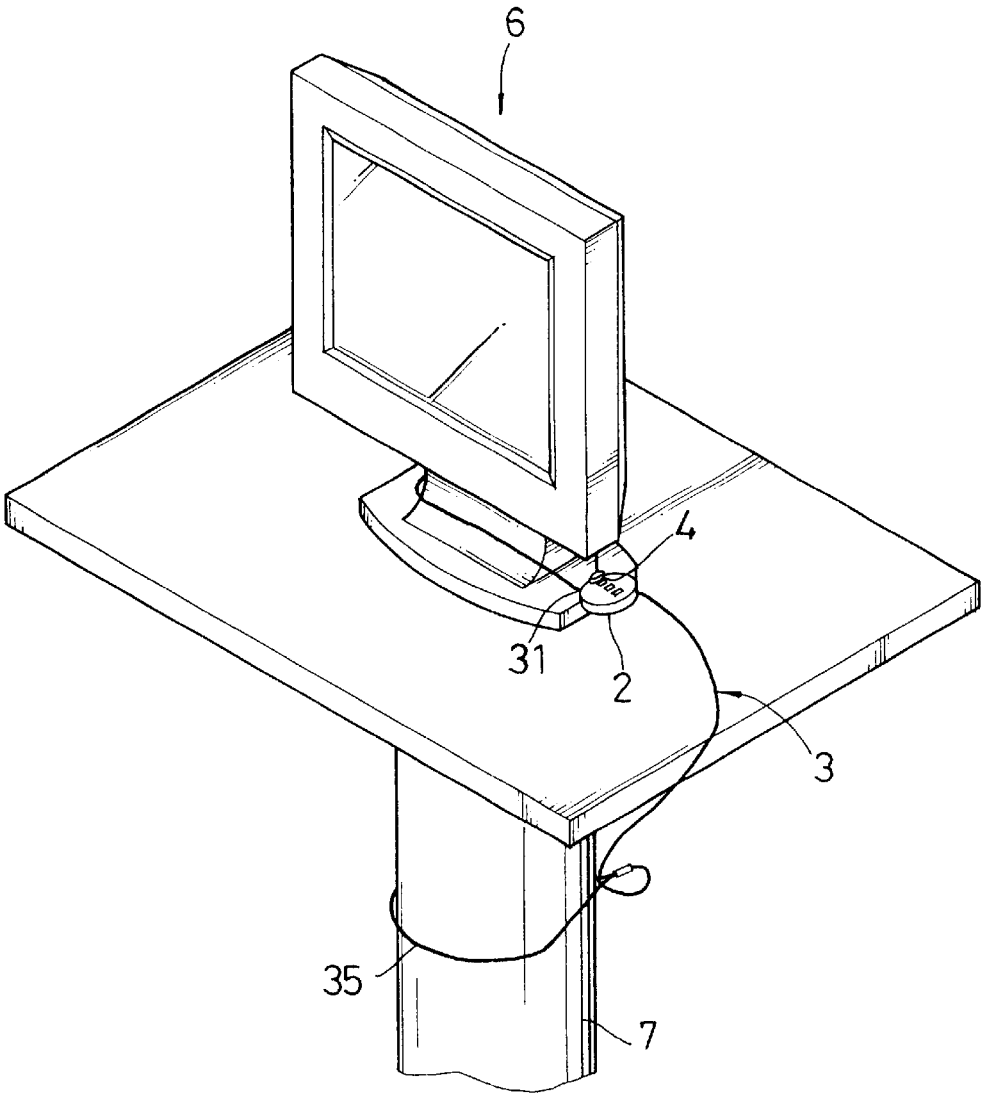
FIG. 16 is a schematic view showing that a monitor is secured by the second embodiment of the cable lock.
Figure 17:
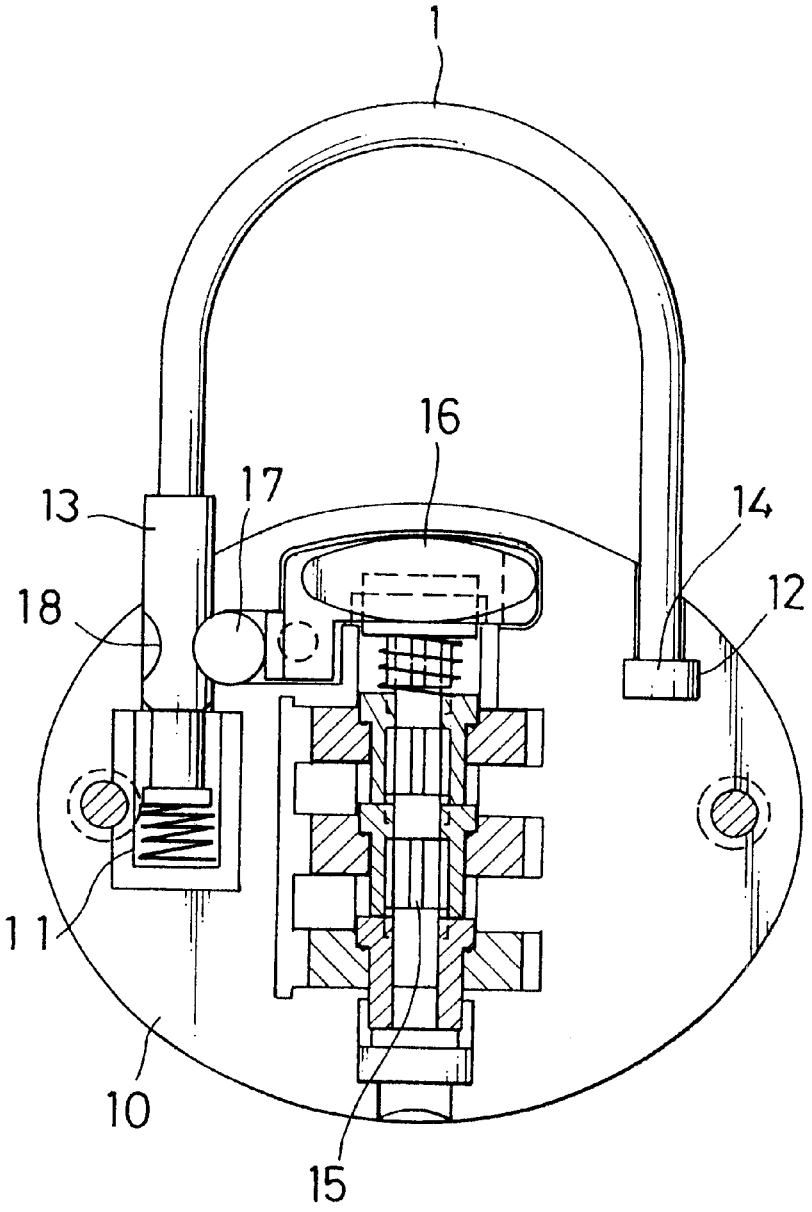
FIG.17 PRIOR ART
FIG. 17 is a cross sectional view of a conventional cable lock.

When the cable lock is locked, the cable (3) can be pulled to tightly fasten an article that is secured by the cable (3). FIG. 16 illustrates that a monitor (6) is safely secured between the body (2) and the cable (3), and the cord (35) is secured on a support (7).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable lock comprising:

a body (2) being composed of a first housing and a second housing, the body (2) having a latch hole (21) defined at a first side of the body (2), an elongated hole (22) defined through the body (2) and at a second side of the body (2), a button (4) received in a button hole (23) between the latch hole (21) and the elongated hole (22), a slot (24) defined between the button hole (23) and the latch hole (21), a ball (26) received in the slot and extending in the latch hole (21) in a locked status, the button (4) having a step (42) formed at a side facing the latch hole (21) and in alignment with the slot (24) for receiving the ball (26) in a unlocked status and a cutout (43) defined at another side facing the elongated hole (22), a hook (27) pivotally mounted on a pin (25) formed in the body (2) and adjacent the elongated hole (22), the hook (27) having a straight end (29) abutting the cutout (43) and a curved end (20) extending in the elongated hole (22), a shaft (50) of a dial (5) received in the body (2) and connected with the button (4); and a cable (3) having a latch head (31) secured in the latch hole (31) by the ball (24) engaged in a ring notch (33) defined on the latch head (31), and a fixed head (32) extending through the elongated hole (22), whereby, when a sequence of the dial (5) is incorrect, the latch head (31) and the fixed head (32) can not be released from the latch hole (21) and the elongated hole (22) but the fixed head (32) can be pulled to shorten a length of the cable (3) between the latch hole (21) and the elongated hole (22); when the dial (5) is turned to a correct sequence, the latch head (31) can be released from the latch hole (21), and the cable (3) can be freely moved in the elongated hole (22).

2. The cable lock as claimed in claim 1, wherein the fixed head (32) of the cable (3) has a second latch head (34).

3. The cable lock as claimed in claim 1, wherein the fixed head (32) of the cable (3) has a cord (35).

4. The cable lock as claimed in claim 1, wherein the button (4) has a bottom inclined surface (44), and the shaft (50) has an upper inclined surface (53) formed at a top thereof and engaged with the bottom inclined surface (44), and a resilient member (36) provided thereon.

* * * * *